US010100598B2

(12) United States Patent
Stæhr

(10) Patent No.: US 10,100,598 B2
(45) Date of Patent: Oct. 16, 2018

(54) DOWNHOLE EXPANDABLE METAL TUBULAR

(71) Applicant: WELLTEC A/S, Allerød (DK)

(72) Inventor: Lars Stæhr, Allerød (DK)

(73) Assignee: Welltec A/S, Allerød (DK)

( * ) Notice: Subject to any disclaimer, the term of this patent is extended or adjusted under 35 U.S.C. 154(b) by 153 days.

(21) Appl. No.: 15/185,885

(22) Filed: Jun. 17, 2016

(65) Prior Publication Data

US 2016/0369587 A1 Dec. 22, 2016

(30) Foreign Application Priority Data

Jun. 19, 2015 (EP) ..... 15172895

(51) Int. Cl.
*E21B 43/10* (2006.01)
*E21B 33/128* (2006.01)
(Continued)

(52) U.S. Cl.
CPC ..... *E21B 33/1208* (2013.01); *E21B 33/127* (2013.01); *E21B 43/103* (2013.01); *E21B 2033/005* (2013.01)

(58) Field of Classification Search
CPC ..... E21B 43/103; E21B 43/108; E21B 17/01014; E21B 33/1208; E21B 33/128; E21B 33/1285
(Continued)

(56) References Cited

U.S. PATENT DOCUMENTS

2015/0068774 A1 3/2015 Hallundbæk et al.

FOREIGN PATENT DOCUMENTS

EP 2 789 791 10/2014
WO WO 2014/167096 10/2014

OTHER PUBLICATIONS

Extended Search Report for EP 15172895.3, dated Dec. 10, 2015, 7 pages.

*Primary Examiner* — Cathleen R Hutchins
(74) *Attorney, Agent, or Firm* — Nixon & Vanderhye P.C.

(57) ABSTRACT

The present invention relates to a downhole expandable metal tubular to be expanded in a well downhole from a first outer diameter to a second outer diameter to abut against an inner face of a casing or borehole, the downhole expandable metal tubular having an outer tubular face and a longitudinal extension and comprising a first circumferential edge and a second circumferential edge provided on the outer tubular face and having a distance along the longitudinal extension, and a circumferential sealing element being arranged between the circumferential edges, wherein the downhole expandable metal tubular further comprises: a circumferential resilient element having an outer face part facing away from the outer tubular face and having an extension along the longitudinal extension, the extension of the circumferential resilient element being smaller than the distance, a space arranged adjacent to the circumferential resilient element in the longitudinal extension, and a first portion of the circumferential sealing element at least partly overlapping the outer face part of the circumferential resilient element, the circumferential resilient element arranged between the portion of the circumferential sealing element and the outer tubular face. Furthermore, the present invention relates to an annular barrier, to a downhole completion system and to a sealing method.

17 Claims, 12 Drawing Sheets

(51) Int. Cl.
*E21B 33/12* (2006.01)
*E21B 33/127* (2006.01)
*E21B 33/00* (2006.01)

(58) Field of Classification Search
USPC ..... 277/607
See application file for complete search history.

DOWNHOLE EXPANDABLE METAL TUBULAR

This application claims priority to EP Patent Application No. 15172895.3 filed 19 Jun. 2015, the entire contents of which is hereby incorporated by reference.

FIELD OF THE INVENTION

The present invention relates to a downhole expandable metal tubular to be expanded in a well downhole from a first outer diameter to a second outer diameter to abut against an inner face of a casing or borehole. Furthermore, the present invention relates to an annular barrier, to a downhole completion system and to a sealing method.

BACKGROUND ART

When expanding metal tubulars, the residual stresses cause the downhole expandable metal tubular to spring back towards its original position and thus to a somewhat smaller outer diameter, and when using such a metal tubular for a patch or annular barrier downhole, the sealing ability to the borehole or casing is challenged by this spring-back effect. Many seals are not capable of withstanding the high and varying pressure and temperature and will therefore fail over time, if not when the patch or annular barrier is expanded.

SUMMARY OF THE INVENTION

It is an object of the present invention to wholly or partly overcome the above disadvantages and drawbacks of the prior art. More specifically, it is an object to provide an improved downhole expandable metal tubular capable of sealing against a borehole or casing downhole and capable of withstanding the high pressure and temperature downhole.

The above objects, together with numerous other objects, advantages and features, which will become evident from the below description, are accomplished by a solution in accordance with the present invention by a downhole expandable metal tubular to be expanded in a well downhole from a first outer diameter to a second outer diameter to abut against an inner face of a casing or borehole, the downhole expandable metal tubular having an outer tubular face and a longitudinal extension and comprising:

- a first circumferential edge and a second circumferential edge provided on the outer tubular face and having a distance along the longitudinal extension, and
- a circumferential sealing element arranged between the circumferential edges, wherein the downhole expandable metal tubular further comprises:
- a circumferential resilient element having an outer face part facing away from the outer tubular face and having an extension along the longitudinal extension, the extension of the circumferential resilient element being smaller than the distance,
- a space arranged adjacent to the circumferential resilient element in the longitudinal extension, and
- a portion of the circumferential sealing element at least partly overlapping the outer face part of the circumferential resilient element, the circumferential resilient element being arranged between the portion of the circumferential sealing element and the outer tubular face.

The circumferential sealing element may have one or more recess(es) in which the circumferential resilient element may be arranged.

In addition, the circumferential sealing element may comprise a second portion, the second portion and the portion defining the recess in which the circumferential resilient element may be arranged.

Furthermore, the second portion may have a first portion thickness, the first portion thickness being greater than a height of the circumferential resilient element.

Moreover, the portion of the circumferential sealing element may have a second portion thickness, the first portion thickness of the second portion being greater than the second portion thickness of the portion.

Also, the recess may have a recess extension along the longitudinal extension and the extension of the circumferential resilient element may be smaller than the recess extension.

Further, the circumferential sealing element may be resilient.

Moreover, the circumferential resilient element may be more resilient than the circumferential sealing element.

Furthermore, the circumferential sealing element may be a first circumferential sealing element and the downhole expandable metal tubular may comprise a second circumferential sealing element.

Additionally, the circumferential resilient element may be a first circumferential resilient element and the downhole expandable metal tubular may comprise a second circumferential resilient element.

The circumferential sealing element may be made of Polyether ether ketone (PEEK), Polytetrafluoroethylene (PTFE), Perfluoroalkoxy alkanes (PFA) or a material having properties similar to those of PEEK, PTFE or PFA.

Also, the circumferential sealing element may be made of a material having a melting point above 230° C., preferably above 250° C., and more preferably above 300° C.

Moreover, the circumferential resilient element may be a coiled spring.

In addition, the circumferential resilient element may be made of silicone or an elastomer.

The downhole expandable metal tubular may have a first thickness between the first circumferential edge and the second circumferential edge and a second thickness in adjacent areas, the first thickness being smaller than the second thickness.

Further, the first circumferential edge and the second circumferential edge may be part of a groove provided in the outer tubular face of the downhole expandable metal tubular.

Also, the first circumferential edge and the second circumferential edge may extend in a radial extension in relation to the downhole expandable metal tubular, said radial extension being perpendicular to the longitudinal extension of the downhole expandable metal tubular.

The first circumferential edge and the second circumferential edge may have edge faces, and these edge faces may be inclined to form an angle in relation to the longitudinal extension of the downhole expandable metal tubular, said angle being at least 110°, and preferably 135°.

Moreover, the downhole expandable metal tubular may be corrugated, forming projections and grooves, and the downhole expandable metal tubular may have a substantially even thickness.

Additionally, the grooves may have a smaller extension along the longitudinal extension than the projections.

Furthermore, the downhole expandable metal tubular may end in projections which are end projections.

Said projections between the grooves may be smaller in extension than the end projections.

Also, the projections may have a longitudinal extension.

Moreover, the projections may have a straight part substantially parallel to the longitudinal extension.

Further, a split, ring-shaped retaining element may be arranged between the first circumferential edge and/or the second circumferential edge and the circumferential sealing element, the split, ring-shaped retaining element forming a back-up for the circumferential sealing element, and the split, ring-shaped retaining element may have more than one winding, so that when the expandable metal tubular is expanded from the first outer diameter to the second outer diameter, the split, ring-shaped retaining element partly unwinds.

Additionally, the split, ring-shaped retaining element may be arranged in an abutting manner to the circumferential sealing element.

Also, the split, ring-shaped retaining element may preferably be made of a material having a yield strength of at least 69 MPa, and preferably at least 100 MPa.

Moreover, the split, ring-shaped retaining element may unwind by less than one winding when the expandable metal tubular is expanded from the first outer diameter to the second outer diameter.

The split, ring-shaped retaining element may have more than one winding in the second outer diameter of the downhole expandable metal tubular.

In addition, the split, ring-shaped retaining element may have a width in the longitudinal extension, the width being substantially the same in the first outer diameter and the second outer diameter of the downhole expandable metal tubular.

Furthermore, the split, ring-shaped retaining element may have a plurality of windings.

Also, the split, ring-shaped retaining element and the circumferential sealing element may substantially fill a gap provided between the first circumferential edge and the second circumferential edge.

Further, the split, ring-shaped retaining element may be made of a spring material.

Additionally, the split, ring-shaped retaining element may be arranged on a first side of the circumferential sealing element, and a second split, ring-shaped retaining element may be arranged on another side of the circumferential sealing element opposite the first side.

Moreover, the split, ring-shaped retaining element may retain the circumferential sealing element in a position along the longitudinal extension of the downhole expandable metal tubular while expanding the split, ring-shaped retaining element and the circumferential sealing element.

The ring-shaped retaining element may be a split ring.

Furthermore, an intermediate element may be arranged between the split, ring-shaped retaining element and the circumferential sealing element.

Also, the split, ring-shaped retaining element and the intermediate element may be arranged in an abutting manner to the circumferential sealing element, so that at least one of the split, ring-shaped retaining element and the intermediate element abuts the circumferential sealing element.

In addition, the intermediate element may be made of polytetrafluoroethylene (PTFE) or polymer.

Further, the downhole expandable metal tubular may be a patch to be expanded within a casing or well tubular structure in a well, a liner hanger to be at least partly expanded within a casing or well tubular structure in a well, or a casing to be at least partly expanded within another casing.

Moreover, the downhole expandable metal tubular may be provided with at least one circumferential projection.

The present invention also relates to an annular barrier to be expanded in an annulus between a well tubular structure and an inner face of a borehole or a casing downhole for providing zone isolation between a first zone and a second zone of the borehole, comprising:

- a tubular metal part for mounting as part of the well tubular structure,
- a downhole expandable metal tubular as described above, surrounding the tubular metal part and having an outer tubular face facing towards the inner face of the borehole or the casing, each end of the downhole expandable metal tubular being connected with the tubular metal part, and
- an expansion space between the downhole expandable metal tubular and the tubular metal part.

An expansion opening may be arranged in the tubular metal part, through which fluid may enter into the expansion space in order to expand the downhole expandable metal tubular.

Furthermore, a sleeve may be arranged between the downhole expandable metal tubular and the tubular metal part, the sleeve being connected with the tubular metal part and the downhole expandable metal tubular, thereby dividing the expansion space into a first space section and a second space section.

Also, the downhole expandable metal tubular may have an opening providing fluid communication between the first zone or the second zone and one of the space sections.

Moreover, the projection may be a ring-shaped projection of an increased thickness in relation to other parts of the downhole expandable metal tubular, the ring-shaped projection providing an enforcement of the annular barrier when the annular barrier is expanded.

The present invention further relates to a downhole completion comprising a downhole expandable metal tubular as described above and a casing having an inner face against which at least part of the downhole expandable metal tubular is expanded.

The downhole completion mentioned above may furthermore comprise a well tubular structure and an annular barrier as described above, where the tubular metal part of the annular barriers may be mounted as part of the well tubular structure.

Finally, the present invention relates to a sealing method comprising:

- providing a downhole expandable metal tubular as described above,
- expanding the downhole expandable metal tubular from a first outer diameter to a second outer diameter to abut against an inner face of a casing or borehole,
- maintaining expansion of the downhole expandable metal tubular so that the portion of the circumferential sealing element at least partly overlapping the circumferential resilient element presses on the outer face part of the circumferential resilient element so that it deforms into the space adjacent to the circumferential resilient element, and
- releasing expansion so that the downhole expandable metal tubular springs slightly back, causing the pressure on the portion to be released so that the circumferential resilient element, due to its resilient character, is able to return to its previous form and thereby press the portion of the circumferential sealing element to abut against the inner face of the casing or borehole for enhanced sealing therebetween.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
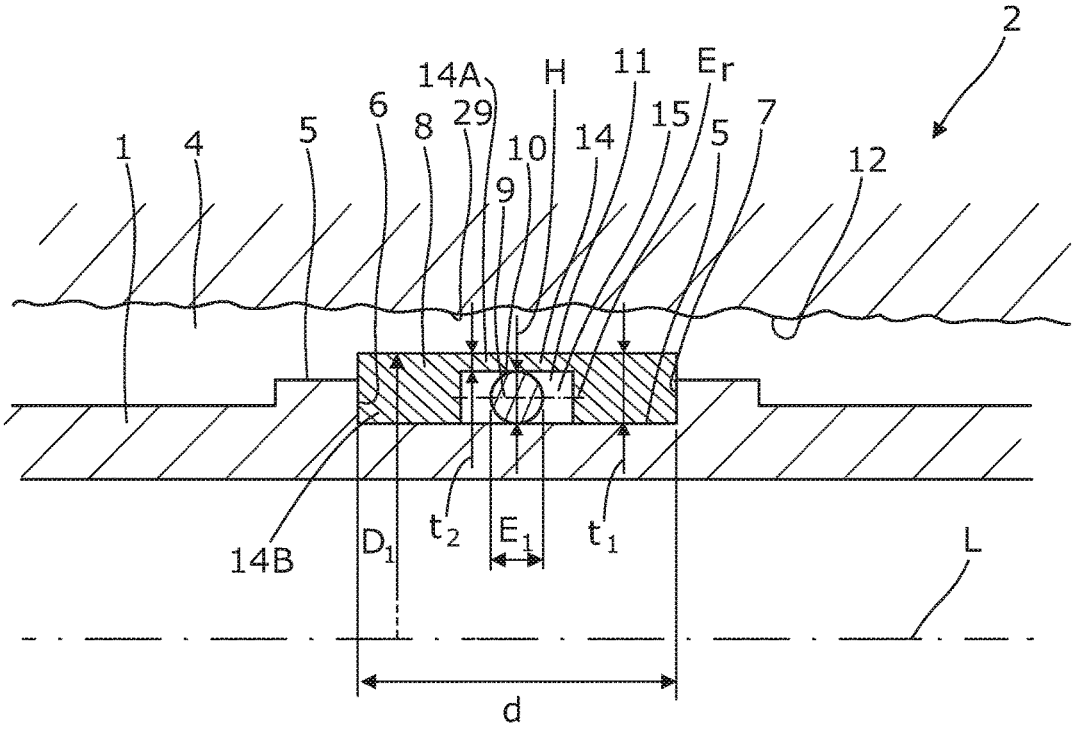
FIG. 1A shows a partly cross-sectional view of an unexpanded downhole expandable metal tubular.
Figure 1B:
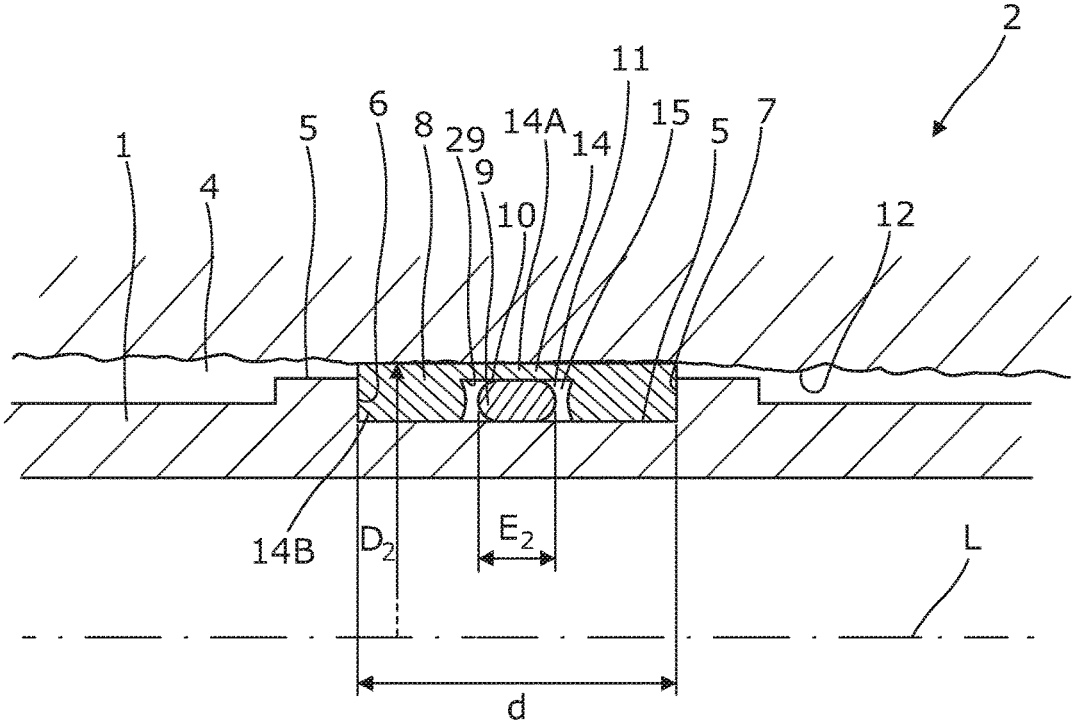
FIG. 1B shows a partly cross-sectional view of an expanded downhole expandable metal tubular.
Figure 2:
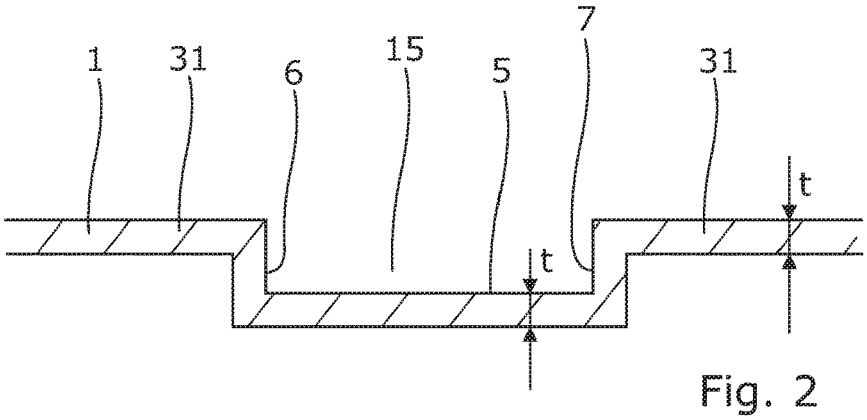
FIGS. 2-7 show partly cross-sectional views of different expanded downhole expandable metal tubulars without any sealing elements.
Figure 3:
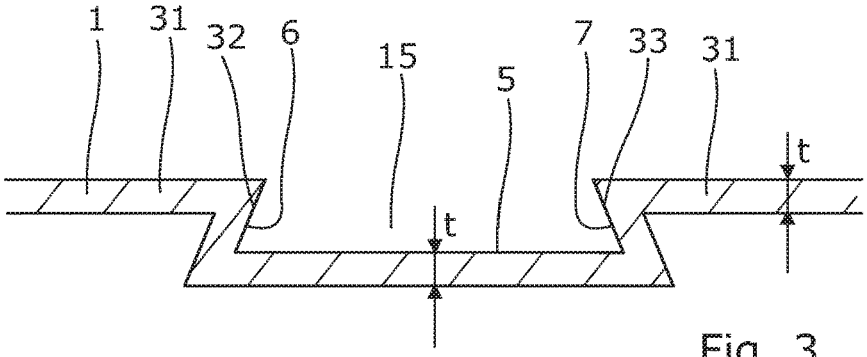
Figure 4:
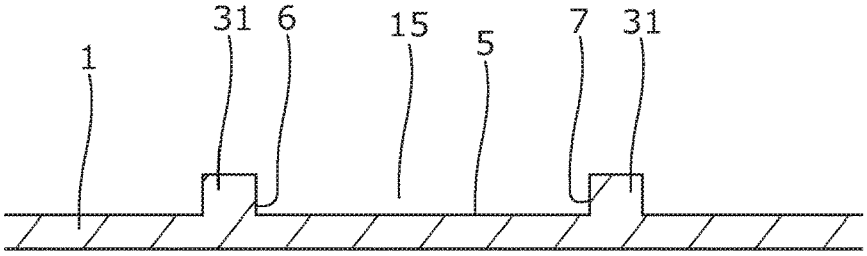

FIGS. 1A and 1B show a downhole expandable metal tubular 1 to be expanded in a well 2 downhole from a first outer diameter $D_1$, as shown in FIG. 1A, to a second outer diameter $D_2$ to abut against an inner face 12 of a casing or borehole 4, as shown in FIG. 1B. The downhole expandable metal tubular 1 has an outer tubular face 5 and a longitudinal extension L along a longitudinal extension of the borehole. The downhole expandable metal tubular 1 comprises a first circumferential edge 6 and a second circumferential edge 7 provided on the outer tubular face 5. As can be seen, the first circumferential edge and the second circumferential edge extend substantially radially outwards from the longitudinal extension L in a radial extension perpendicular to the longitudinal extension, and have a distance d along the longitudinal extension providing a groove 15 in the downhole expandable metal tubular 1. A circumferential sealing element 8 is arranged between the circumferential edges 6, 7 for sealing against the inner face 12 of the borehole 4. The downhole expandable metal tubular 1 further comprises a circumferential resilient element 9 having an outer face part 10 facing away from the outer tubular face 5. The circumferential resilient element 9 has an extension $E_1$, $E_2$ along the longitudinal extension L, and the extension of the circumferential resilient element is smaller than the distance between the circumferential edges 6, 7. In FIG. 1A, the circumferential resilient element 9 has an unexpanded extension $E_1$ which is smaller than the expanded extension $E_2$ of the circumferential resilient element 9 shown in FIG. 1B. A portion 14, being a first portion 14A, of the circumferential sealing element 8 overlaps the outer face part 10 of the circumferential resilient element, so that the circumferential resilient element is arranged between the portion 14 of the circumferential sealing element and the outer tubular face 5. A space 11 is defined adjacent to the circumferential resilient element 9 in the longitudinal extension in the groove 15 and between the circumferential sealing element 8 and the circumferential resilient element 9. During expansion of the downhole expandable metal tubular 1, the portion 14 of the circumferential sealing element 8 is pressed downwards when abutting the inner face 12 of the borehole 4, so that the circumferential resilient element 9 is squeezed between the portion and the outer tubular face 5, thereby increasing the extension of the circumferential resilient element 9. After the expansion of the downhole expandable metal tubular 1, the residual stresses cause the downhole expandable metal tubular 1 to spring back towards its original position and thus to a somewhat smaller outer diameter. When this happens, the circumferential resilient element 9 will also partly, if not entirely, return to its original position, shown in FIG. 1A, and thus press the portion 14 of the circumferential sealing element 8 towards the inner face 12 of the borehole 4, maintaining the sealing effect of the circumferential sealing element 8.

In FIG. 1A, the circumferential sealing element comprises a second portion 14B, the second portion and the first portion 14, 14A defining a recess 29 in which the circumferential resilient element is arranged. The second portion has a first portion thickness $t_1$ being greater than a height H of the circumferential resilient element. The first portion 14, 14A of the circumferential sealing element has a second portion thickness $t_2$, and the first portion thickness $t_1$ of the second portion 14B is greater than the second portion thickness $t_2$ of the first portion 14, 14A.

The circumferential sealing element 8 and the circumferential resilient element 9 are seen in cross-section in FIGS. 1A and 1B and are tubular in the same way as the downhole expandable metal tubular 1. The downhole expandable metal tubular 1 may have a variety of cross-sectional shapes, as shown in FIGS. 2-7.

Figure 5:
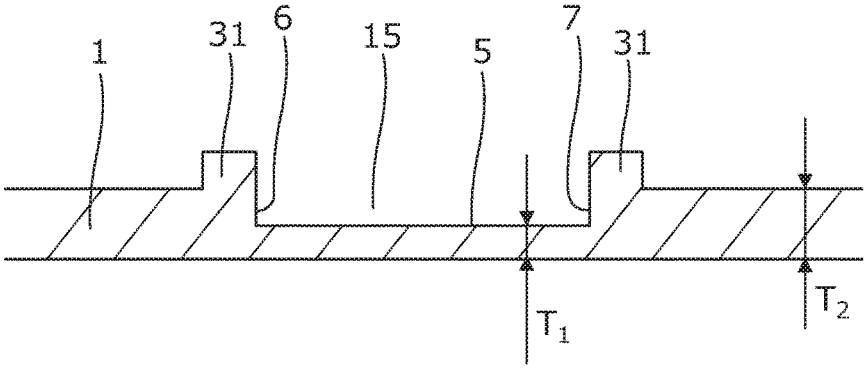
Figure 6:
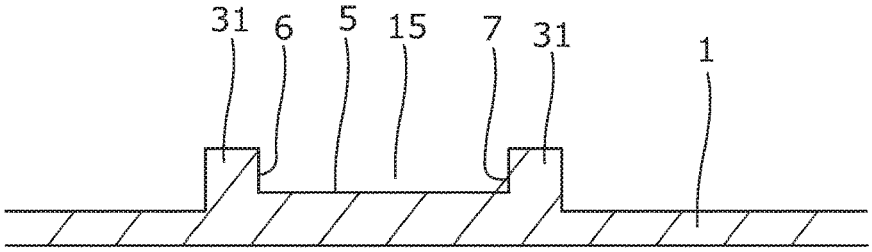
Figure 7:
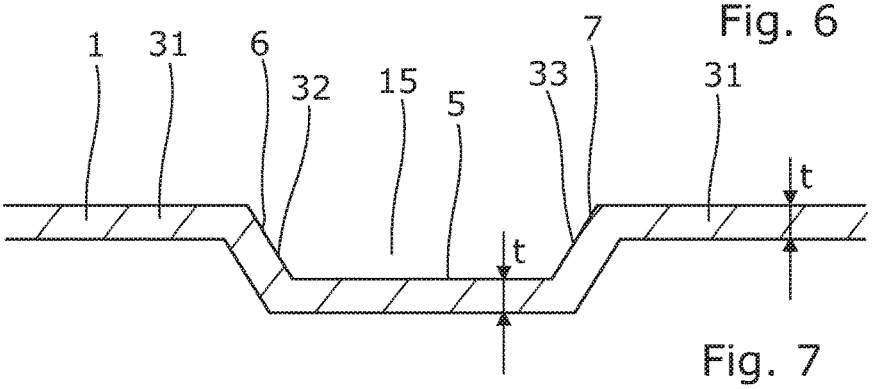

As can be seen in FIG. 5, the downhole expandable metal tubular has a first thickness $T_1$ between the first circumferential edge 6 and the second circumferential edge 7 and a second thickness $T_2$ in adjacent areas, the first thickness $T_1$ being smaller than the second thickness $T_2$. In this way, the expansion fluid will expand the part having the smallest thickness $T_1$ somewhat more than the part having the greater thickness $T_2$.

Figure 8:
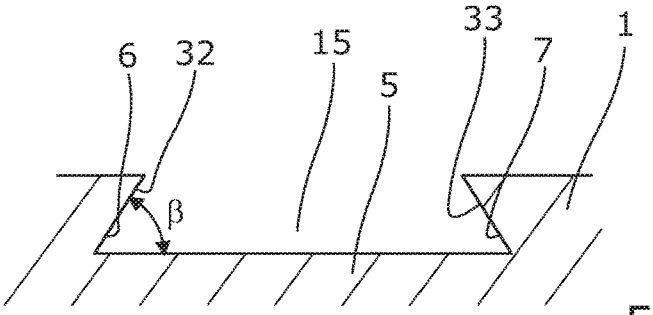
FIGS. 8-10 show partly cross-sectional views of different expanded downhole expandable metal tubulars having inclined and uninclined edges.
Figure 9:
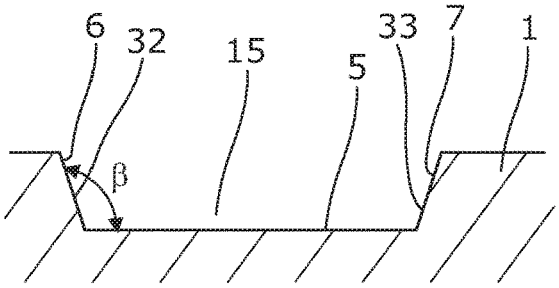
Figure 10:
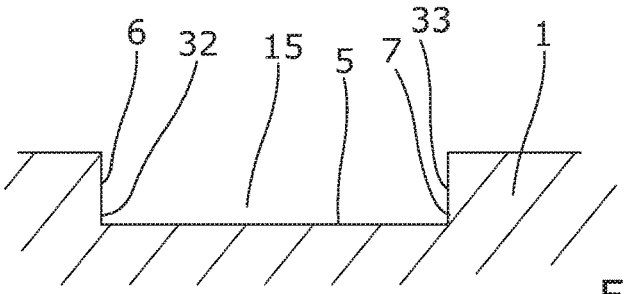

The downhole expandable metal tubular 1 has the first circumferential edge 6 and the second circumferential edge 7 which may extend radially outwards, as shown in FIGS. 1A, 1B and 10. The downhole expandable metal tubular may, however, also have inclining edges being the end faces 32, 33, as shown in FIG. 8 where the edges incline towards each other, minimising the groove 15 in relation to that shown in FIG. 10, and as shown in FIG. 9 where the edges incline away from each other, increasing the groove 15 in relation to that shown in FIG. 10. Thus, the first circumferential edge 6 and the second circumferential edge 7 have edge faces 32, 33, and as shown in FIGS. 8 and 9, the edge faces incline to form an angle β in relation to the longitudinal extension of the downhole expandable metal tubular 1. The angle β shown in FIG. 8 is smaller than 90°, and in FIG. 9, the angle β is larger than 90°.

In FIGS. 2, 3, 7, 31 and 32, the downhole expandable metal tubular is corrugated like sheet piling, forming projections 31 and grooves 15, and the downhole expandable metal tubular has a substantially even thickness t. The grooves may have a smaller extension along the longitudinal extension than the projections. The downhole expandable metal tubular ends in projections 31 which are end projections. The projections 31 between the grooves 15 may be smaller in extension than the end projections. Furthermore, the projections have a straight part substantially parallel to the longitudinal extension.

Figure 11:
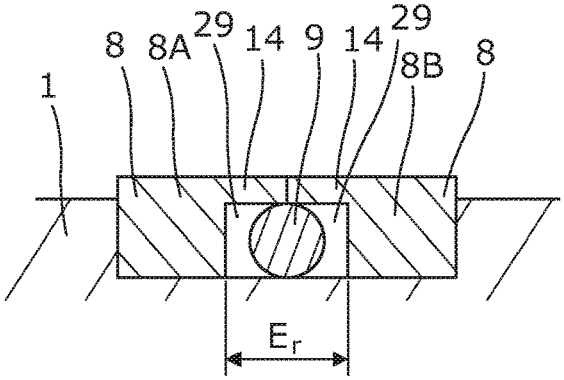
FIGS. 11-20 show partly cross-sectional views of different circumferential sealing elements and circumferential resilient elements in a groove of the downhole expandable metal tubular.
Figure 12:
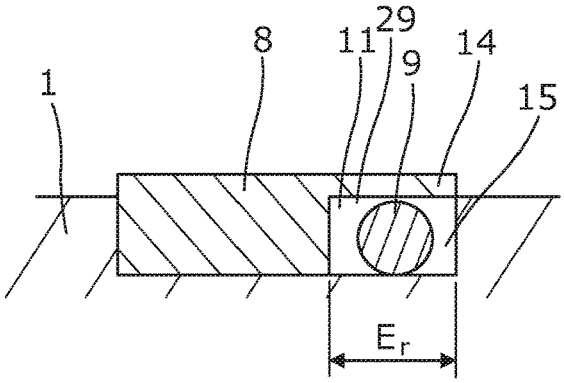
Figure 13:
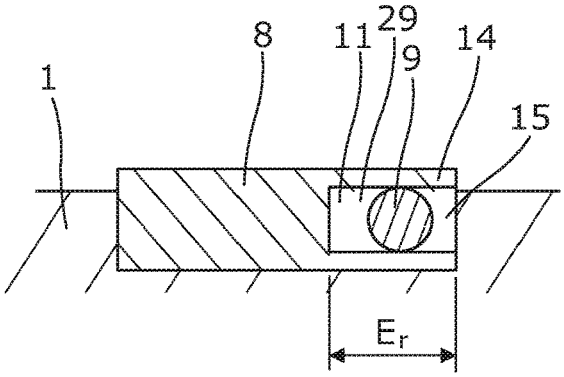
Figure 14:
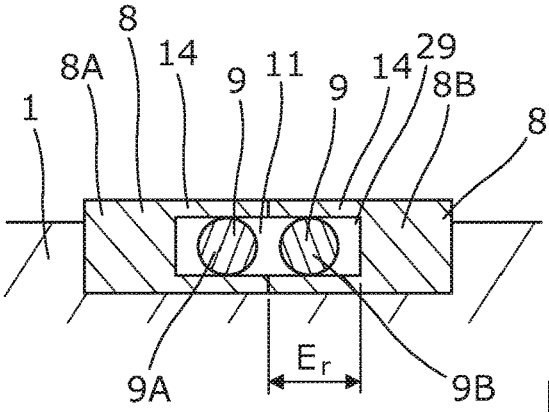
Figure 15:
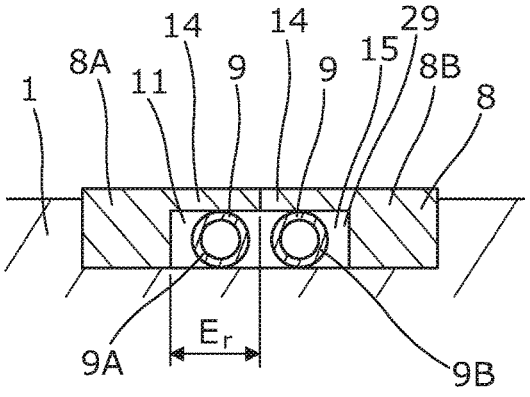
Figure 16:
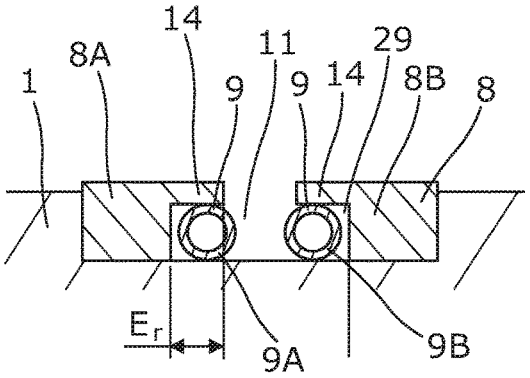
Figure 17:
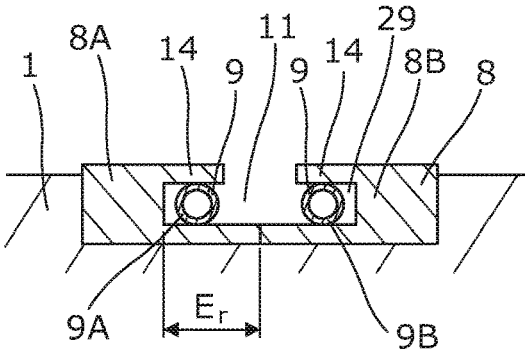
Figure 18:
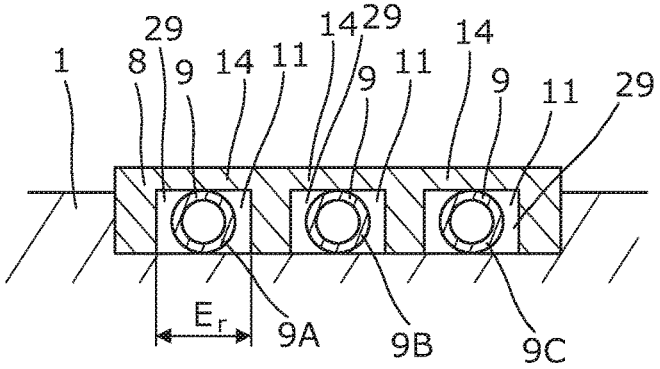
Figure 19:
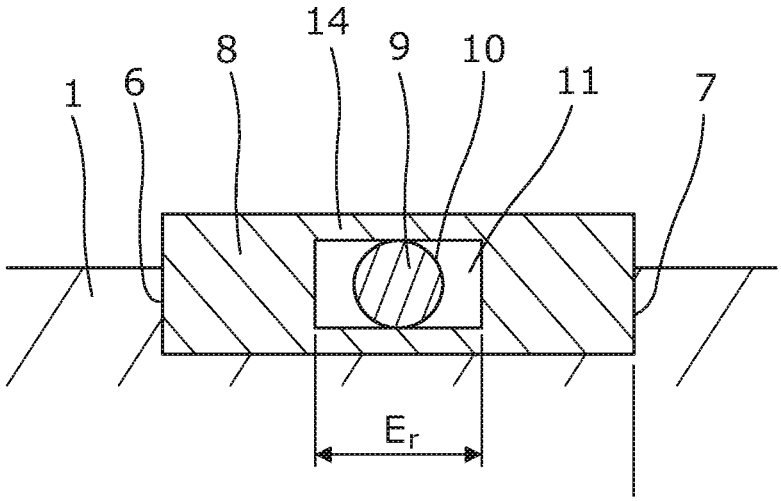
Figure 20:
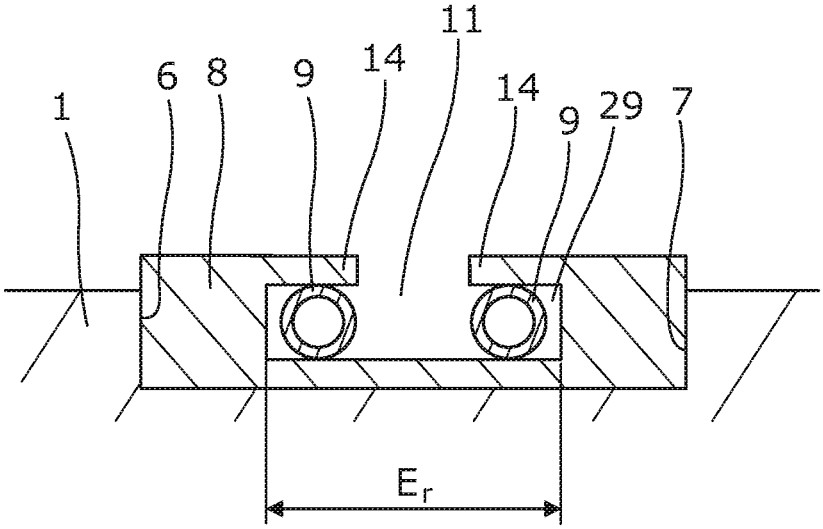
Figure 21:
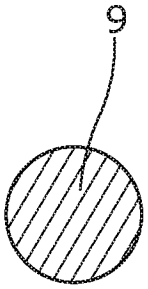
FIGS. 21-27 show cross-sectional views of different circumferential resilient elements.
Figure 22:
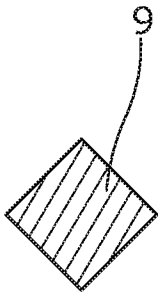
Figure 23:
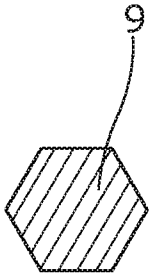
Figure 24:
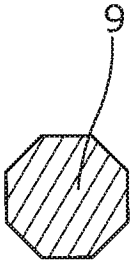
Figure 25:
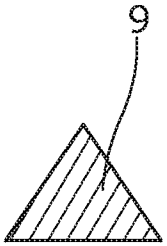
Figure 26:
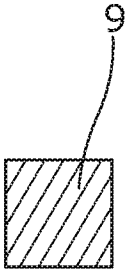
Figure 27:
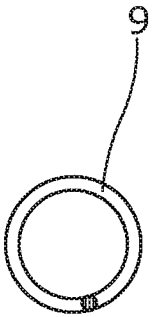

The circumferential sealing element 8 and the circumferential resilient element 9 may have a variety of shapes. In FIGS. 1A, 12, 13, 19 and 20, the circumferential sealing element 8 has one recess 29 in which the circumferential resilient element 9 is arranged. In FIG. 19, the circumferential sealing element 8 is enclosing the circumferential resilient element 9 which is arranged in a through-going recess of the circumferential sealing element 8. In FIG. 11, the downhole expandable metal tubular 1 comprises two circumferential sealing elements 8, a first circumferential sealing element 8A and a second circumferential sealing element 8B, both having a portion 14 overlapping the circumferential resilient element 9. In FIG. 18, the circumferential sealing element 8 has three recesses 29, each comprising a circumferential resilient element 9. Thus, the downhole expandable metal tubular 1 of FIG. 18 comprises a first circumferential resilient element 9A, a second circumferential resilient element 9B and a third circumferential resilient element 9C. The circumferential sealing element 8 has three portions 14, each overlapping a circumferential resilient element 9. In FIGS. 14, 15, 16 and 17, the downhole expandable metal tubular 1 comprises two circumferential sealing elements 8 as well as two circumferential resilient elements 9. In FIGS. 14 and 15, the portions 14 abut each other in the unexpanded condition shown, but in FIG. 16, the circumferential sealing elements 8 have a mutual distance between them.

Figure 28:
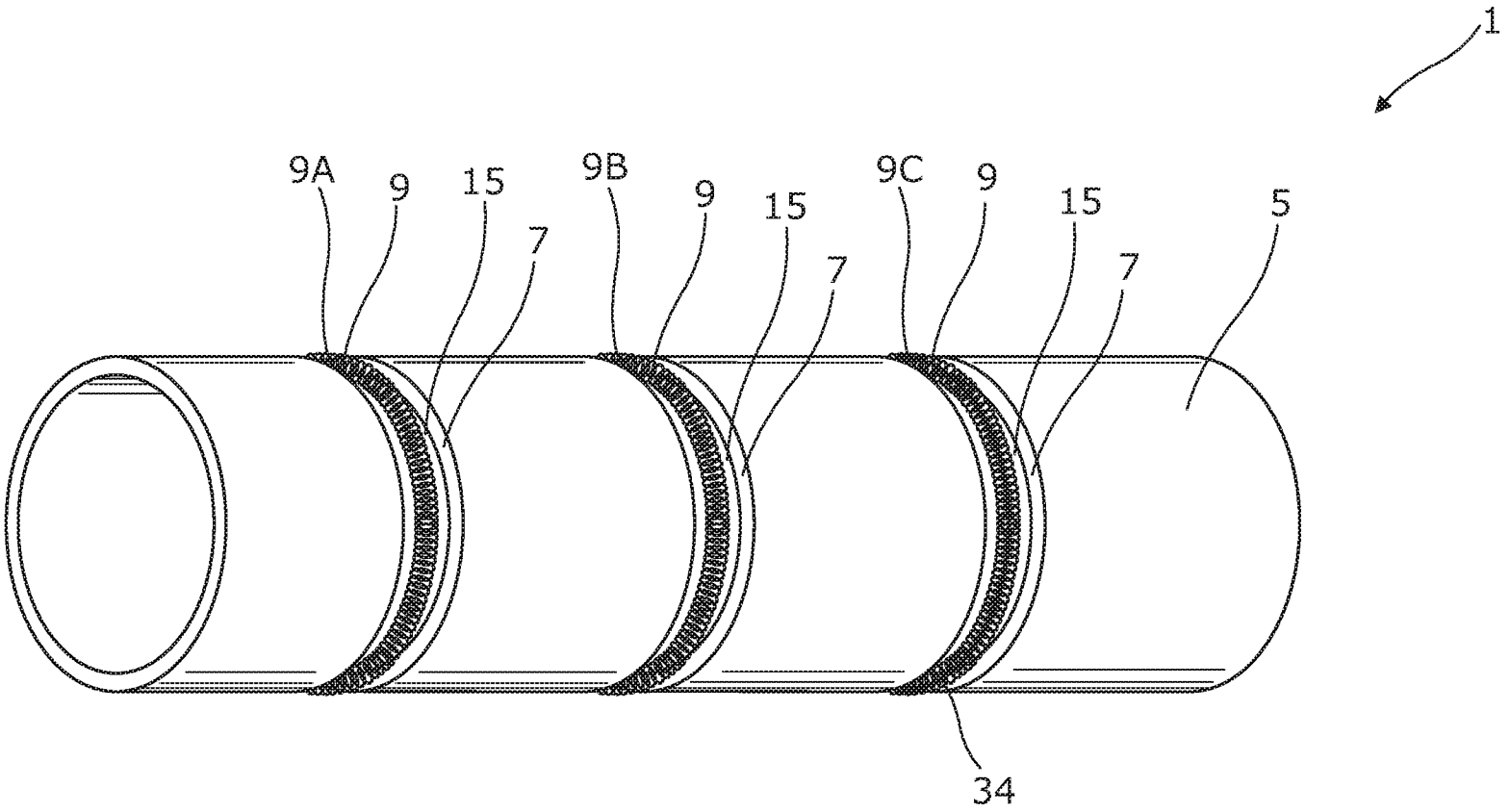
FIG. 28 shows a downhole expandable metal tubular in perspective having helical metal coils.

The circumferential resilient element 9 may have a variety of cross-sectional shapes, as shown in FIGS. 21-27, and the circumferential resilient element 9 may be a solid ring, as shown in FIGS. 11-14, 19 and 21-26. Furthermore, the circumferential resilient element 9 may also be a coiled spring, as shown in FIGS. 15-18, 20 and 27. As shown in FIG. 28, in which the circumferential sealing elements are not shown, the helical metal coil 9 is arranged as a ring around the downhole expandable metal tubular 1, so that the windings of the coil extend around a coil axis 34 parallel to the circumference of the downhole expandable metal tubular 1. The circumferential resilient element 9 may also be a hollow ring, as shown in FIG. 15, besides a coiled spring also called a helical metal coil, as shown in FIGS. 18 and 28.

The recess 29 in the circumferential sealing element 8 shown in FIGS. 1A and 12-20 has a recess extension $E_r$ along the longitudinal extension. The extension of the circumferential resilient element is smaller than the recess extension, which defines a space 11, so that the circumferential resilient element 9 is able to expand in the longitudinal extension while being compressed during expansion of the downhole expandable metal tubular 1.

The circumferential resilient element is more resilient than the circumferential sealing element, and the circumferential sealing element 8 protects the circumferential resilient element 9, e.g. against high temperatures. The circumferential sealing element 8 is therefore made of Polyether ether ketone (PEEK), Polytetrafluoroethylene (PTFE), Perfluoroalkoxy alkanes (PFA) or a material having properties similar to those of PEEK, PTFE or PFA. The circumferential sealing element 8 is made of a material having a melting point above 230° C., preferably above 250° C., and more preferably above 300° C. The circumferential resilient element 9 may be made of silicone or an elastomer providing the resilient ability of the circumferential resilient element 9.

Figure 31:
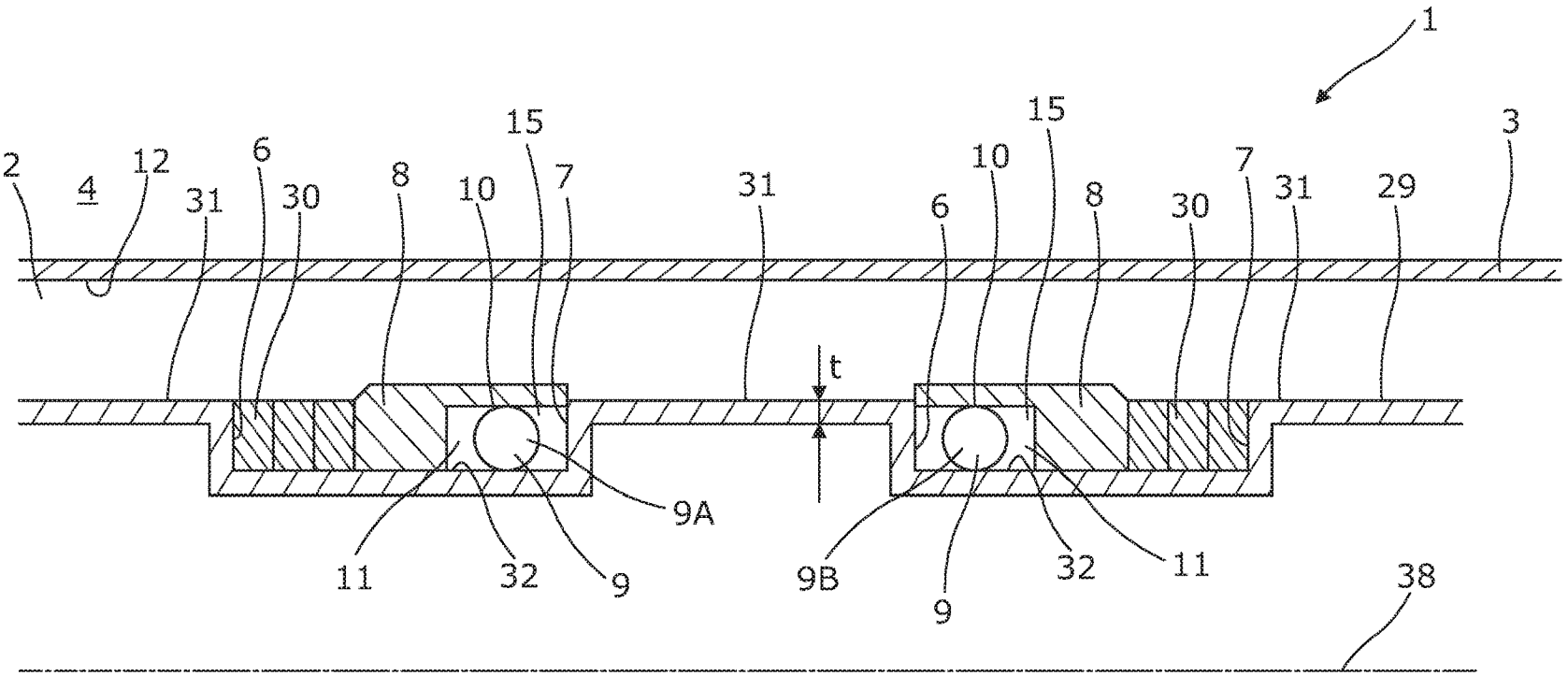
FIG. 31 shows a partly cross-sectional view of an unexpanded downhole expandable metal tubular.
Figure 32:
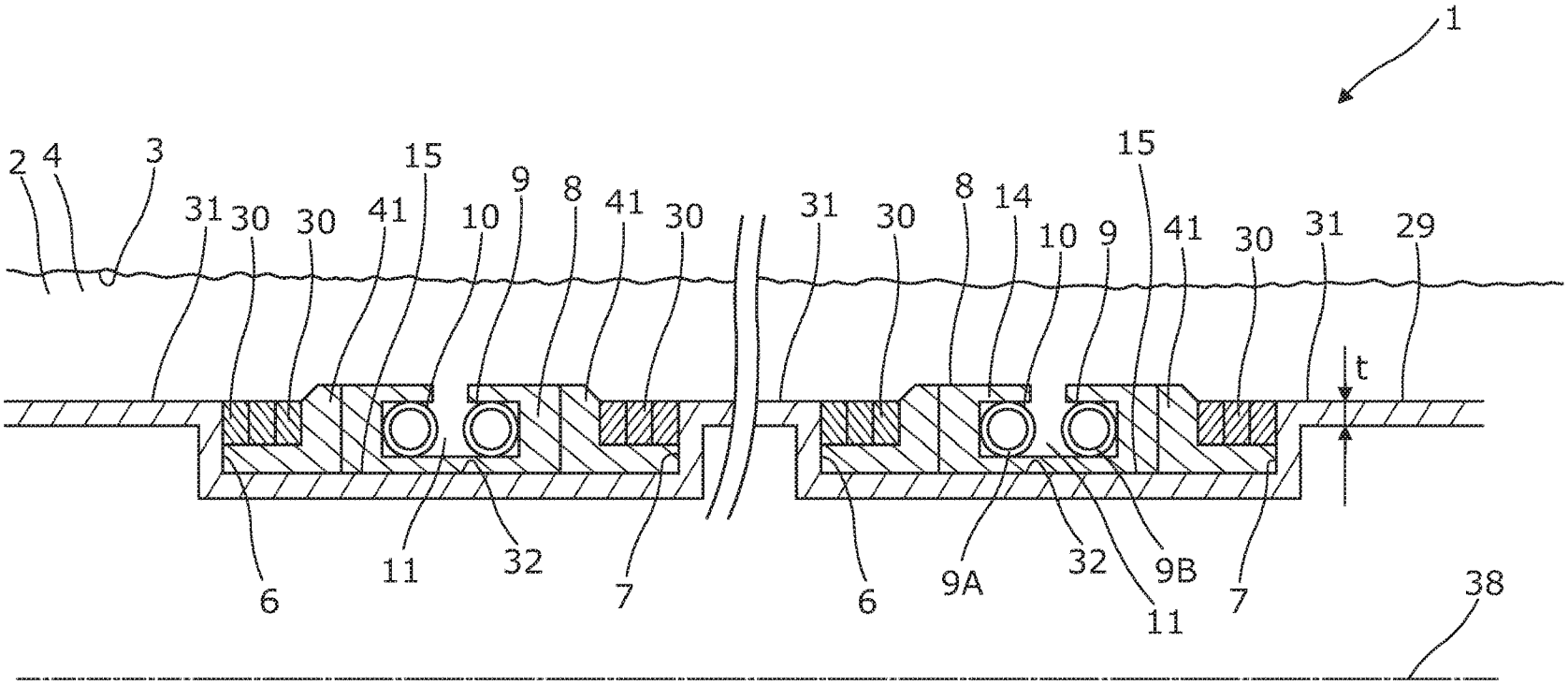
FIG. 32 shows a partly cross-sectional view of another unexpanded downhole expandable metal tubular.

In FIGS. 31 and 32, the downhole expandable metal tubular 1 further comprises a split, ring-shaped retaining element 30 arranged between the first circumferential edge 6 and/or the second circumferential edges 7 and the circumferential sealing element 8. The split, ring-shaped retaining element 30 forms a back-up for the circumferential sealing element during expansion and when sealing against varying pressures from the adjacent zones. The split, ring-shaped retaining element thus retains the circumferential sealing element in a position along the longitudinal extension of the downhole expandable metal tubular while expanding the split, ring-shaped retaining element and the circumferential sealing element. The split, ring-shaped retaining element 30 has more than one winding and is in FIG. 31 shown with three windings, so that when the downhole expandable metal tubular is expanded from the first outer diameter to the second outer diameter, the split, ring-shaped retaining element 30, e.g. a split ring, partly unwinds by less than one winding when the expandable metal tubular is expanded from the first outer diameter to the second outer diameter. The split, ring-shaped retaining element 30 is arranged in such a way that it abuts the circumferential sealing element 8. Thus, the split, ring-shaped retaining element 30 and the circumferential sealing element 8 substantially fill a gap provided between the first circumferential edge 6 and the second circumferential edge 7. The split, ring-shaped retaining element is preferably made of a material having a yield strength of at least 69 MPa, preferably at least 100 MPa, and may be made of a spring material.

As shown in FIG. 32, the split, ring-shaped retaining element 30 is arranged on a first side of the circumferential sealing element, and a second split, ring-shaped retaining element 30 is arranged on another side of the circumferential sealing element opposite the first side.

As can be seen in FIG. 32, an intermediate element 41 may be arranged between the split, ring-shaped retaining element and the circumferential sealing element. Thus, the split, ring-shaped retaining element 30 and the intermediate element 41 are arranged in such a way that they abut the circumferential sealing element 8, so that the intermediate element abuts the circumferential sealing element and the split, ring-shaped retaining element 30 abuts the intermediate element 41. The intermediate element may be made of polytetrafluoroethylene (PTFE) or polymer.

Figure 30:
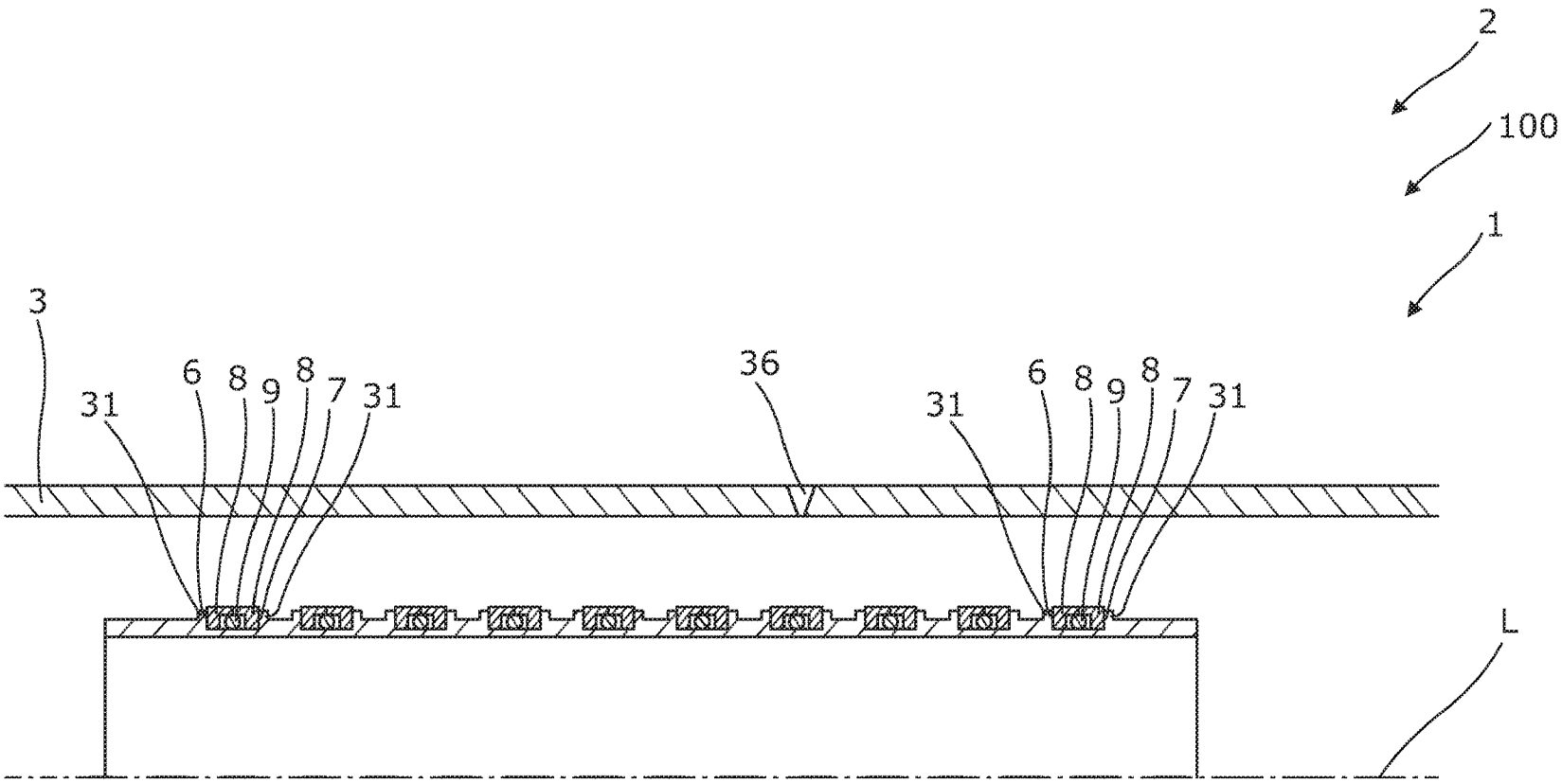
FIG. 30 shows a cross-sectional view of another unexpanded downhole expandable metal tubular forming a patch.

In FIG. 30, the downhole expandable metal tubular 1 is a patch to be expanded within a casing 3 or well tubular structure in a well 2. The downhole expandable metal tubular 1 may also be a liner hanger to be at least partly expanded within the casing 3 or well tubular structure in the well 2, or be a casing to be at least partly expanded within another casing.

Figure 29:
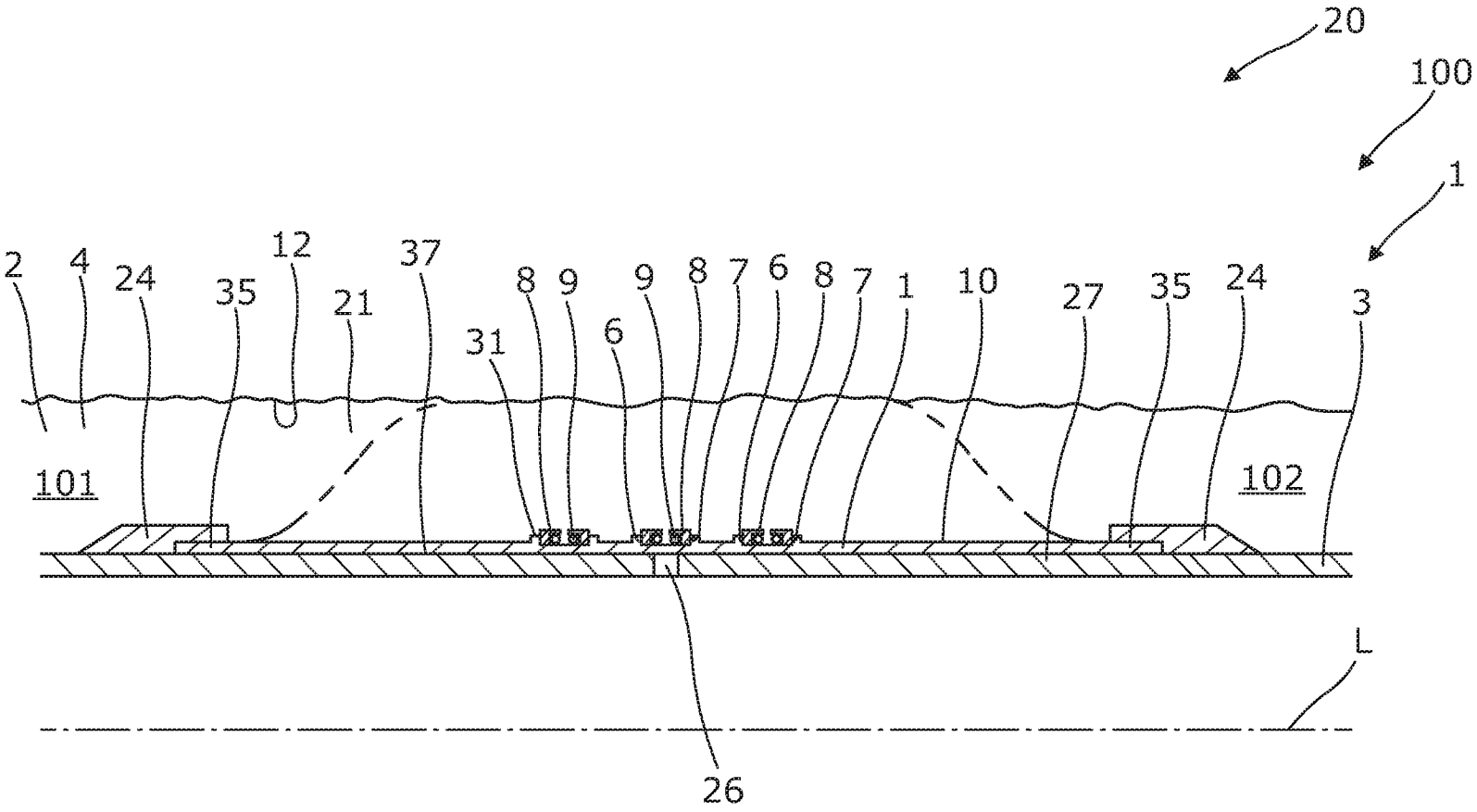
FIG. 29 shows a cross-sectional view of an unexpanded downhole expandable metal tubular forming part of an annular barrier.

FIG. 29 shows an annular barrier 20 to be expanded in an annulus 21 between a well tubular structure 3 and an inner face 12 of a borehole 4 or a casing 3 downhole for providing zone isolation between a first zone 101 and a second zone 102 of the borehole. The annular barrier 20 comprises a tubular metal part 27 which is mounted as part of the well tubular structure 3, and a downhole expandable metal tubular 1 surrounding the tubular metal part and having an outer tubular face 10 facing towards the inner face of the borehole or the casing. Each end 35 of the downhole expandable metal tubular 1 is connected with the tubular metal part 27 to define an expansion space 37 between the downhole expandable metal tubular and the tubular metal part.

The annular barrier 20 has an expansion opening 26 arranged in the tubular metal part 27 through which fluid may enter into the expansion space in order to expand the downhole expandable metal tubular as indicated by the dotted lines in FIG. 29.

FIGS. 29 and 30 show a downhole completion 100 comprising the downhole expandable metal tubular and the casing 3 having an inner face 12 against which at least part of the downhole expandable metal tubular is expanded. In FIG. 30, the downhole expandable metal tubular 1 is a patch for sealing a leak 36, and in FIG. 29, the downhole expandable metal tubular 1 forms part of the annular barrier 20.

Furthermore, the present invention also relates to a sealing method comprising the steps of providing a downhole expandable metal tubular expanding the downhole expandable metal tubular from a first outer diameter $D_1$ to a second outer diameter $D_2$ to abut against an inner face of a casing or borehole, maintaining expansion of the downhole expandable metal tubular so that the portion 14 of the circumferential sealing element at least partly overlapping the circumferential resilient element presses on the outer face part of the circumferential resilient element so that it deforms into the space adjacent to the circumferential resilient element, and releasing expansion so that the downhole expandable metal tubular springs slightly spring, causing the pressure on the portion to be released so that the circumferential resilient element, due to its resilient character, is able to return to its previous form and thereby press the portion of the circumferential sealing element to abut against the inner face of the casing or borehole for enhanced sealing therebetween.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production casing or well tubular structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole expandable metal tubular to be expanded in a well downhole from a first outer diameter to a second outer diameter to abut against an inner face of a casing or borehole, the downhole expandable metal tubular having an outer tubular face and a longitudinal axis and comprising:

a first circumferential edge and a second circumferential edge provided on the outer tubular face, the first circumferential edge and the second circumferential edge forming part of a groove provided in the outer tubular face, the groove having a first length extending along the longitudinal axis, and a circumferential sealing element arranged in the groove between the circumferential edges, wherein the downhole expandable metal tubular further comprises:

a circumferential resilient element having an outer face part facing away from the outer tubular face and having a second length as measured along the longitudinal axis, the second length being smaller than the first length, a space arranged adjacent to the circumferential resilient element along the longitudinal axis, a first portion of the circumferential sealing element at least partly overlapping the outer face part of the circumferential resilient element, the circumferential resilient element being arranged between the portion of the circumferential sealing element and the outer tubular face; wherein:

the circumferential sealing element has at least one recess in which the circumferential resilient element is arranged, the at least one recess being located in the groove.

2. A downhole expandable metal tubular according to claim 1, wherein the circumferential sealing element comprises a second portion, the second portion and the first portion defining the at least one recess in which the circumferential resilient element is arranged.

3. A downhole expandable metal tubular according to claim 2, wherein the second portion has a first portion thickness, the first portion thickness being greater than a height of the circumferential resilient element.

4. A downhole expandable metal tubular according to claim 3, wherein the first portion of the circumferential sealing element has a second portion thickness, the first portion thickness of the second portion being greater than the second portion thickness of the portion.

5. A downhole expandable metal tubular according to claim 1, wherein the at least one recess has a recess extension along the longitudinal axis and the second length is smaller than the recess extension.

6. A downhole expandable metal tubular according to claim 1, wherein the circumferential resilient element is more resilient than the circumferential sealing element.

7. A downhole expandable metal tubular according to claim 1, wherein the circumferential sealing element is a first circumferential sealing element and the downhole expandable metal tubular comprises a second circumferential sealing element.

8. A downhole expandable metal tubular according to claim 1, wherein the circumferential resilient element is a first circumferential resilient element and the downhole expandable metal tubular comprises a second circumferential resilient element.

9. A downhole expandable metal tubular according to claim 1, wherein the circumferential sealing element is made of Polyether ether ketone (PEEK), Polytetrafluoroethylene (PTFE), or Perfluoroalkoxy alkanes (PFA).

10. A downhole expandable metal tubular according to claim 1, wherein the circumferential sealing element is made of a material having a melting point above 230° C.

11. A downhole expandable metal tubular according to claim 1, wherein the circumferential resilient element is a coiled spring.

12. A downhole expandable metal tubular according to claim 1, wherein a split, ring-shaped retaining element is arranged between the first circumferential edge and/or the second circumferential edge and the circumferential sealing element, the split, ring-shaped retaining element forming a back-up for the circumferential sealing element, and wherein the split, ring-shaped retaining element has more than one winding, so that when the expandable metal tubular is expanded from the first outer diameter to the second outer diameter, the split, ring-shaped retaining element partly unwinds.

13. A downhole expandable metal tubular according to claim 12, wherein the split, ring-shaped retaining element unwinds by less than one winding when the expandable metal tubular is expanded from the first outer diameter to the second outer diameter.

14. An annular barrier to be expanded in an annulus between a well tubular structure and an inner face of a borehole or a casing downhole for providing zone isolation between a first zone and a second zone of the borehole, comprising:

a tubular metal part for mounting as part of the well tubular structure, a downhole expandable metal tubular according to claim 1, surrounding the tubular metal part and having an outer tubular face facing towards the inner face of the borehole or the casing, each end of the downhole expandable metal tubular being connected with the tubular metal part, and an expansion space between the downhole expandable metal tubular and the tubular metal part.

15. A downhole completion comprising a downhole expandable metal tubular according to claim 1 and a casing having an inner face against which at least part of the downhole expandable metal tubular is expanded.

16. A downhole completion comprising a well tubular structure and an annular barrier according to claim 15, where the tubular metal part of the annular barrier is mounted as part of the well tubular structure.

17. A sealing method comprising:

providing a downhole expandable metal tubular according to claim 1, expanding the downhole expandable metal tubular from a first outer diameter to a second outer diameter to abut against an inner face of a casing or borehole, maintaining expansion of the downhole expandable metal tubular so that the portion of the circumferential sealing element at least partly overlapping the circumferential resilient element presses on the outer face part of the circumferential resilient element so that it deforms into the space adjacent to the circumferential resilient element, and releasing expansion so that the downhole expandable metal tubular springs slightly back, causing the pressure on the portion to be released so that the circumferential resilient element, due to resiliency, is able to return to a previous form of the resilient element and thereby press the portion of the circumferential sealing element to abut against the inner face of the casing or borehole for enhanced sealing therebetween.

* * * * *